US008845498B2

(12) United States Patent
Webb

(10) Patent No.: US 8,845,498 B2
(45) Date of Patent: Sep. 30, 2014

(54) LOCKOUT MECHANISM FOR A WEIGHT STACK EXERCISE MACHINE

(75) Inventor: Gregory M. Webb, Independence, VA (US)

(73) Assignee: Nautilus, Inc., Vancouver, WA (US)

( * ) Notice: Subject to any disclaimer, the term of this patent is extended or adjusted under 35 U.S.C. 154(b) by 351 days.

(21) Appl. No.: 13/077,012

(22) Filed: Mar. 31, 2011

(65) Prior Publication Data

US 2012/0004080 A1 Jan. 5, 2012

Related U.S. Application Data

(60) Provisional application No. 61/319,662, filed on Mar. 31, 2010.

(51) Int. Cl.
*A63B 21/00* (2006.01)

(52) U.S. Cl.
USPC ..... 482/107; 482/130; 482/132; 482/93

(58) Field of Classification Search
USPC ..... 482/142, 130, 132, 105, 106, 93, 107, 482/108
See application file for complete search history.

(56) References Cited

U.S. PATENT DOCUMENTS

| | | | |
|---|---|---|---|
| 2,855,199 | A | 10/1958 | Noland et al. |
| 2,921,791 | A | 1/1960 | Berne |
| 3,306,611 | A | 2/1967 | Gaul |
| 3,588,101 | A | 6/1971 | Jungreis |
| 3,638,941 | A | 2/1972 | Kulkens |
| 3,662,602 | A | 5/1972 | Weiss |
| 3,822,599 | A | 7/1974 | Brentham |
| 3,856,297 | A | 12/1974 | Schnell |
| 4,076,236 | A | 2/1978 | Ionel |
| 4,290,597 | A | 9/1981 | Schleffendorf |
| 4,336,934 | A | 6/1982 | Hanagan et al. |
| 4,357,010 | A | 11/1982 | Telle |
| RE31,113 | E | 12/1982 | Coker et al. |
| 4,405,128 | A | 9/1983 | McLaughlin et al. |
| 4,426,077 | A | 1/1984 | Becker |
| 4,453,710 | A | 6/1984 | Plötz |
| 4,478,411 | A | 10/1984 | Baldwin |
| 4,502,681 | A | 3/1985 | Blomqvist |
| 4,529,197 | A | 7/1985 | Gogarty |
| 4,529,198 | A | 7/1985 | Hettick, Jr. |
| 4,538,805 | A | 9/1985 | Parviainen |

(Continued)

FOREIGN PATENT DOCUMENTS

| | | | |
|---|---|---|---|
| CN | 2430184 | Y | 5/2001 |
| EP | 0121902 | A1 | 10/1984 |

(Continued)

OTHER PUBLICATIONS

U.S. Appl. No. 13/076,876, filed Mar. 31, 2011, Golesh.

(Continued)

*Primary Examiner* — Jerome W Donnelly
(74) *Attorney, Agent, or Firm* — Dorsey & Whitney LLP

(57) ABSTRACT

A lockout mechanism for a selection mechanism on an exercise machine, the selection mechanism being associated with a carriage for selectively carrying load. The carriage may include a support system adjustable by the selection mechanism for adjusting the amount of load to be carried. The lockout mechanism may include a lockout member configured to prevent adjustment of the selection mechanism during exercise.

11 Claims, 10 Drawing Sheets

(56) References Cited

U.S. PATENT DOCUMENTS

| | | | |
|---|---|---|---|
| 4,546,971 | A | 10/1985 | Raasoch |
| 4,598,908 | A | 7/1986 | Morgan |
| 4,627,614 | A | 12/1986 | de Angeli |
| 4,627,615 | A | 12/1986 | Nurkowski |
| 4,700,944 | A | 10/1987 | Sterba et al. |
| 4,722,522 | A | 2/1988 | Lundgren |
| 4,756,526 | A | 7/1988 | Broussard |
| 4,787,629 | A | 11/1988 | DeMyer |
| 4,804,179 | A | 2/1989 | Murphy et al. |
| 4,822,034 | A | 4/1989 | Shields |
| 4,834,396 | A | 5/1989 | Schnell |
| 4,854,578 | A | 8/1989 | Fulks |
| 4,858,915 | A | 8/1989 | Szabo |
| 4,861,025 | A | 8/1989 | Rockwell |
| 4,880,229 | A | 11/1989 | Broussard |
| 4,902,007 | A | 2/1990 | Ferrari |
| 4,944,511 | A | 7/1990 | Francis |
| 4,951,939 | A | 8/1990 | Peters |
| 4,971,305 | A | 11/1990 | Rennex |
| 4,982,957 | A | 1/1991 | Shields |
| 5,002,271 | A | 3/1991 | Gonzales |
| 5,050,873 | A | 9/1991 | Jones |
| D321,025 | S | 10/1991 | Jones |
| D321,026 | S | 10/1991 | Jones |
| D321,027 | S | 10/1991 | Jones |
| D321,028 | S | 10/1991 | Jones |
| 5,060,938 | A | 10/1991 | Hawley, Jr. |
| D321,387 | S | 11/1991 | Jones |
| D321,389 | S | 11/1991 | Jones |
| D321,390 | S | 11/1991 | Jones |
| D321,391 | S | 11/1991 | Jones |
| 5,066,003 | A | 11/1991 | Jones |
| 5,066,004 | A | 11/1991 | Jones |
| 5,094,450 | A | 3/1992 | Stearns |
| 5,106,080 | A | 4/1992 | Jones |
| 5,116,297 | A | 5/1992 | Stonecipher |
| 5,123,885 | A | 6/1992 | Shields |
| 5,125,881 | A | 6/1992 | Jones |
| 5,135,449 | A | 8/1992 | Jones |
| 5,135,456 | A | 8/1992 | Jones |
| 5,171,198 | A | 12/1992 | Jones |
| 5,180,354 | A | 1/1993 | Jones |
| 5,181,896 | A | 1/1993 | Jones |
| 5,201,694 | A | 4/1993 | Zappel |
| 5,217,422 | A | 6/1993 | Domzalski |
| 5,230,680 | A | 7/1993 | Wu |
| 5,263,915 | A | 11/1993 | Habing |
| 5,273,504 | A | 12/1993 | Jones |
| 5,273,505 | A | 12/1993 | Jones |
| 5,306,221 | A | 4/1994 | Itaru |
| 5,308,303 | A | 5/1994 | Rawls et al. |
| 5,336,148 | A | 8/1994 | Ish, III |
| 5,380,258 | A | 1/1995 | Hawley, Jr. |
| 5,387,170 | A | 2/1995 | Rawls et al. |
| D359,778 | S | 6/1995 | Towley, III et al. |
| 5,429,570 | A | 7/1995 | Beyer |
| 5,484,367 | A | 1/1996 | Martinez |
| 5,554,084 | A | 9/1996 | Jones |
| 5,554,089 | A | 9/1996 | Jones |
| 5,554,090 | A | 9/1996 | Jones |
| 5,562,577 | A | 10/1996 | Nichols, Sr. et al. |
| 5,569,139 | A | 10/1996 | Civie et al. |
| 5,628,715 | A | 5/1997 | Simonson |
| 5,632,710 | A | 5/1997 | England et al. |
| 5,637,064 | A | 6/1997 | Olson et al. |
| 5,749,813 | A | 5/1998 | Domzalski |
| 5,769,757 | A | 6/1998 | Fulks |
| 5,769,762 | A | 6/1998 | Towley, III et al. |
| 5,779,604 | A | 7/1998 | Towley, III et al. |
| 5,788,615 | A | 8/1998 | Jones |
| 5,788,616 | A | 8/1998 | Polidi |
| 5,810,701 | A | 9/1998 | Ellis et al. |
| 5,839,997 | A | 11/1998 | Roth et al. |
| 5,876,313 | A | 3/1999 | Krull |
| 5,971,899 | A | 10/1999 | Towley, III et al. |
| 6,015,367 | A | 1/2000 | Scaramucci |
| 6,033,350 | A | 3/2000 | Krull |
| D422,654 | S | 4/2000 | Chen |
| 6,045,491 | A | 4/2000 | McNergney et al. |
| 6,083,144 | A | 7/2000 | Towley, III et al. |
| 6,095,955 | A | 8/2000 | Lee |
| 6,099,442 | A | 8/2000 | Krull |
| 6,117,049 | A | 9/2000 | Lowe |
| 6,149,558 | A | 11/2000 | Chen |
| 6,174,265 | B1 | 1/2001 | Alessandri |
| 6,186,927 | B1 | 2/2001 | Krull |
| 6,186,928 | B1 | 2/2001 | Chen |
| 6,196,952 | B1 | 3/2001 | Chen |
| 6,203,474 | B1 | 3/2001 | Jones |
| 6,228,003 | B1 * | 5/2001 | Hald et al. ..... 482/107 |
| 6,261,022 | B1 | 7/2001 | Dalebout et al. |
| 6,322,481 | B1 | 11/2001 | Krull |
| 6,350,221 | B1 | 2/2002 | Krull |
| 6,364,815 | B1 | 4/2002 | Lapcevic |
| 6,402,666 | B2 | 6/2002 | Krull |
| 6,416,446 | B1 | 7/2002 | Krull |
| 6,422,979 | B1 | 7/2002 | Krull |
| 6,436,013 | B1 | 8/2002 | Krull |
| 6,440,044 | B1 | 8/2002 | Francis et al. |
| 6,443,874 | B1 | 9/2002 | Bennett |
| 6,482,139 | B1 | 11/2002 | Haag |
| 6,500,101 | B1 | 12/2002 | Chen |
| 6,500,106 | B1 | 12/2002 | Fulks |
| 6,517,468 | B1 | 2/2003 | Lapcevic |
| 6,540,650 | B1 | 4/2003 | Krull |
| 6,561,960 | B2 | 5/2003 | Webber |
| 6,595,902 | B1 | 7/2003 | Savage et al. |
| 6,605,024 | B2 | 8/2003 | Stearns |
| 6,629,910 | B1 | 10/2003 | Krull |
| 6,656,093 | B2 | 12/2003 | Chen |
| 6,669,606 | B2 | 12/2003 | Krull |
| 6,679,816 | B1 | 1/2004 | Krull |
| 6,682,464 | B2 | 1/2004 | Shifferaw |
| 6,719,672 | B1 | 4/2004 | Ellis et al. |
| 6,719,674 | B2 | 4/2004 | Krull |
| 6,733,424 | B2 | 5/2004 | Krull |
| 6,746,381 | B2 | 6/2004 | Krull |
| 6,749,547 | B2 | 6/2004 | Krull |
| 6,802,800 | B1 | 10/2004 | Hobson |
| D498,272 | S | 11/2004 | Sanford-Schwentke et al. |
| D500,820 | S | 1/2005 | Krull |
| 6,855,097 | B2 | 2/2005 | Krull |
| 6,872,173 | B2 | 3/2005 | Krull |
| 6,902,516 | B2 | 6/2005 | Krull |
| D508,628 | S | 8/2005 | Crawford et al. |
| 6,974,405 | B2 | 12/2005 | Krull |
| 7,018,325 | B2 | 3/2006 | Shifferaw |
| D521,087 | S | 5/2006 | Francis |
| 7,066,867 | B2 | 6/2006 | Krull |
| 7,077,790 | B1 | 7/2006 | Krull |
| 7,077,791 | B2 | 7/2006 | Krull |
| 7,083,554 | B1 | 8/2006 | Lo Presti |
| 7,090,625 | B2 | 8/2006 | Chermack |
| D528,173 | S | 9/2006 | Flick et al. |
| D528,611 | S | 9/2006 | Flick |
| 7,112,163 | B2 | 9/2006 | Krull |
| 7,121,988 | B2 | 10/2006 | Walkerdine |
| 7,137,931 | B2 | 11/2006 | Liu |
| 7,137,932 | B2 | 11/2006 | Doudiet |
| D533,910 | S | 12/2006 | Dibble et al. |
| 7,153,243 | B1 | 12/2006 | Krull |
| D536,752 | S | 2/2007 | Walkerdine |
| 7,172,536 | B2 | 2/2007 | Liu |
| 7,182,715 | B2 | 2/2007 | Anderson |
| 7,189,190 | B2 | 3/2007 | Lamar et al. |
| D540,405 | S | 4/2007 | Crawford et al. |
| D540,894 | S | 4/2007 | Crawford et al. |
| 7,201,711 | B2 | 4/2007 | Towley, III et al. |
| 7,223,214 | B2 | 5/2007 | Chen |
| 7,229,391 | B2 | 6/2007 | Francis |
| 7,252,627 | B2 | 8/2007 | Carter |
| 7,261,678 | B2 | 8/2007 | Crawford et al. |
| D550,789 | S | 9/2007 | Dibble et al. |
| 7,285,078 | B1 | 10/2007 | Liu |

(56) References Cited

U.S. PATENT DOCUMENTS

| | | | |
|---|---|---|---|
| 7,291,098 | B1 | 11/2007 | Krull |
| 7,306,549 | B2 | 12/2007 | Francis |
| 7,367,927 | B2 | 5/2008 | Krull |
| 7,377,885 | B2 | 5/2008 | Doudiet |
| 7,387,595 | B2 | 6/2008 | Towley, III et al. |
| 7,387,597 | B2 | 6/2008 | Krull |
| 7,413,532 | B1 | 8/2008 | Monsrud et al. |
| 7,413,533 | B2 | 8/2008 | Lin |
| 7,429,235 | B2 | 9/2008 | Lin |
| 7,452,312 | B2 | 11/2008 | Liu |
| 7,485,077 | B2 | 2/2009 | Chen |
| 7,507,189 | B2 | 3/2009 | Krull |
| 7,534,199 | B2 | 5/2009 | Krull |
| 7,540,832 | B2 | 6/2009 | Krull |
| 7,553,265 | B2 | 6/2009 | Crawford et al. |
| 7,591,770 | B2 | 9/2009 | Stewart et al. |
| 7,614,982 | B2 | 11/2009 | Crawford et al. |
| 7,625,322 | B1 | 12/2009 | Krull |
| 7,662,074 | B2 | 2/2010 | Webb |
| 7,736,283 | B2 | 6/2010 | Webb |
| 7,740,568 | B2 | 6/2010 | Webb |
| 7,758,478 | B2 | 7/2010 | Golesh et al. |
| 7,794,373 | B2 | 9/2010 | Crawford et al. |
| 7,887,468 | B2 | 2/2011 | Ross et al. |
| 8,002,680 | B2 | 8/2011 | Crawford et al. |
| 8,016,729 | B2 | 9/2011 | Webb |
| 2002/0025888 | A1 | 2/2002 | Germanton et al. |
| 2002/0077230 | A1 | 6/2002 | Lull et al. |
| 2003/0027697 | A1 | 2/2003 | Baumler |
| 2003/0092542 | A1 | 5/2003 | Bartholomew et al. |
| 2003/0148862 | A1 | 8/2003 | Chen et al. |
| 2003/0199368 | A1 | 10/2003 | Krull |
| 2004/0005969 | A1 | 1/2004 | Chen |
| 2004/0018920 | A1 | 1/2004 | Simonson |
| 2004/0023765 | A1 | 2/2004 | Krull |
| 2004/0220025 | A1 | 11/2004 | Krull |
| 2005/0079961 | A1 | 4/2005 | Dalebout et al. |
| 2005/0085351 | A1 | 4/2005 | Kissel |
| 2006/0025287 | A1 | 2/2006 | Chermack |
| 2006/0030446 | A1 | 2/2006 | Nozaki et al. |
| 2006/0063650 | A1 | 3/2006 | Francis |
| 2006/0100069 | A1 | 5/2006 | Dibble et al. |
| 2006/0105889 | A1 | 5/2006 | Webb |
| 2006/0116249 | A1 | 6/2006 | Dibble et al. |
| 2006/0135328 | A1 | 6/2006 | Doudiet |
| 2006/0205571 | A1 | 9/2006 | Krull |
| 2006/0211550 | A1 | 9/2006 | Crawford et al. |
| 2006/0217245 | A1 | 9/2006 | Golesh et al. |
| 2006/0223684 | A1 | 10/2006 | Krull |
| 2007/0149366 | A1 | 6/2007 | Kuo |
| 2007/0203001 | A1 | 8/2007 | Krull |
| 2007/0275836 | A1 | 11/2007 | Parviainen |
| 2008/0026921 | A1 | 1/2008 | Liu |
| 2008/0039299 | A1 | 2/2008 | Crawford et al. |
| 2008/0085821 | A1 | 4/2008 | Webb |
| 2008/0176722 | A1 | 7/2008 | Steffee |
| 2008/0254952 | A1 | 10/2008 | Webb |
| 2008/0305936 | A1 | 12/2008 | Cao |
| 2009/0186748 | A1 | 7/2009 | Golesh et al. |
| 2010/0035736 | A1 | 2/2010 | Crawford et al. |
| 2011/0003668 | A1 | 1/2011 | Crawford et al. |

FOREIGN PATENT DOCUMENTS

| | | | |
|---|---|---|---|
| EP | 0617986 | A1 | 10/1994 |
| EP | 1614450 | A1 | 1/2006 |
| FR | 1468902 | | 2/1967 |
| FR | 2613237 | | 10/1988 |
| GB | 2232089 | A | 12/1990 |
| JP | 10118222 | | 5/1998 |
| SE | 455573 | | 7/1988 |
| SU | 1258447 | A | 9/1986 |
| SU | 1367987 | A | 1/1988 |
| SU | 1389789 | A | 4/1988 |
| SU | 1643024 | A | 4/1991 |
| SU | 1780780 | A1 | 12/1992 |
| TW | 379572 | | 1/2000 |

OTHER PUBLICATIONS

U.S. Appl. No. 13/077,173, filed Mar. 31, 2011, Webb et al.

Cybex International, Inc., Commercial Strength Systems brochure, 4535 Arm Curl, 5255 Rear Delt, 5281 Arm Curl, Apr. 2000, pp. 9 and 36.

Nautilus Super Smooth Technology, "Equipment Comparison," undated brochure, 1 page.

PCT International Search Report of corresponding PCT International Application No. PCT/US2011/030831 dated Jun. 1, 2011, 2 pages.

* cited by examiner

LOCKOUT MECHANISM FOR A WEIGHT STACK EXERCISE MACHINE

CROSS-REFERENCE TO RELATED APPLICATIONS

This application claims the benefit, under 35 U.S.C. §119 (e), or U.S. Provisional Application No. 61/319,662, entitled "Lockout Mechanism for a Weight Stack Exercise Machine" and filed on Mar. 31, 2010, which is hereby incorporated by reference herein in its entirety.

RELATED APPLICATIONS

The present application relates to U.S. patent application Ser. No. 13/077,173, entitled "Selectable Weight Stack" and filed on Mar. 31, 2011, and U.S. Provisional Patent Application No. 61/319,628, filed on Mar. 31, 2010, and entitled "Selectable Weight Stack," the contents of which are hereby incorporated by reference herein in their entireties.

FIELD OF THE INVENTION

The present disclosure relates to weight stack exercise machines. More particularly, the present disclosure relates to weight stack exercise machines with mechanisms that allow adjustment of the load when not in use, and restrict adjustment when in use.

BACKGROUND

Exercise may take several forms including aerobic or cardiovascular, strength training, flexibility training, and balance training. With particular regard to strength training, two common forms include free weights and exercise machines. In the case of weight training exercise machines, it is common for the machines to include a user interfacing portion such as a graspable bar or handle, a foot press, a leg pad, or other interface. The interface may be connected to a cable or series of cables that may pass through one or a series of pulleys and be connected to one or more weight plates. As a user exercises, the one or more weight plates may be lifted from a resting location.

A common exercise machine may include a weight stack where each plate in the stack is adapted to slide along two guide rods. The cable in these machines may be attached to a selecting probe passing through the weight stack and having a plurality of holes adapted to align with holes in each of the plates in the stack. A selection pin may be inserted into one of the plurality of holes via a hole in a respective weight plate thereby engaging the selected plate, and all of the plates above it, with the selecting probe. Friction may be developed between the selection pin and the weight plates due to the weight of the plates pressing against the surface of the pin. Friction may also be developed between the pin and the selection probe due to the weight of the plates being supported on the pin and all of said weight bearing on the selected hole in the selection probe. As such, the selection pin may be securely positioned in the one or more weights being lifted as soon as the weights are lifted from their resting location and forces come to bear on the selection pin.

SUMMARY

In one embodiment, a lockout mechanism for a selection mechanism on an exercise machine is provided. The selection mechanism may be associated with a carriage for selectively carrying load, and the carriage may have a support system adjustable by the selection mechanism for adjusting the amount of load to be carried. The lockout mechanism for such a selection mechanism may include a lockout member configured to prevent adjustment of the selection mechanism during exercise. The lockout member may have an engaged position and a disengaged position. The lockout member may also include a primary end with a head configured to abut the selection mechanism in the engaged position thereby preventing adjustment of at least a first selection element of the selection mechanism. The lockout mechanism may further include an actuation member configured to move the lockout member from the engaged position to the disengaged position.

While an example of one executions of the invention(s) are disclosed herein, still others will become apparent to those skilled in the art from the following detailed description, which shows and describes illustrative embodiments of the invention(s). As will be realized, by those of ordinary skill in the art upon reading the following disclosure, the invention(s) disclosed herein is and are capable of modifications in various aspects, all without departing from the spirit and scope of the present invention(s). Accordingly, the drawings and detailed description are to be regarded as illustrative in nature and not restrictive.

DETAILED DESCRIPTION

Figure 2:
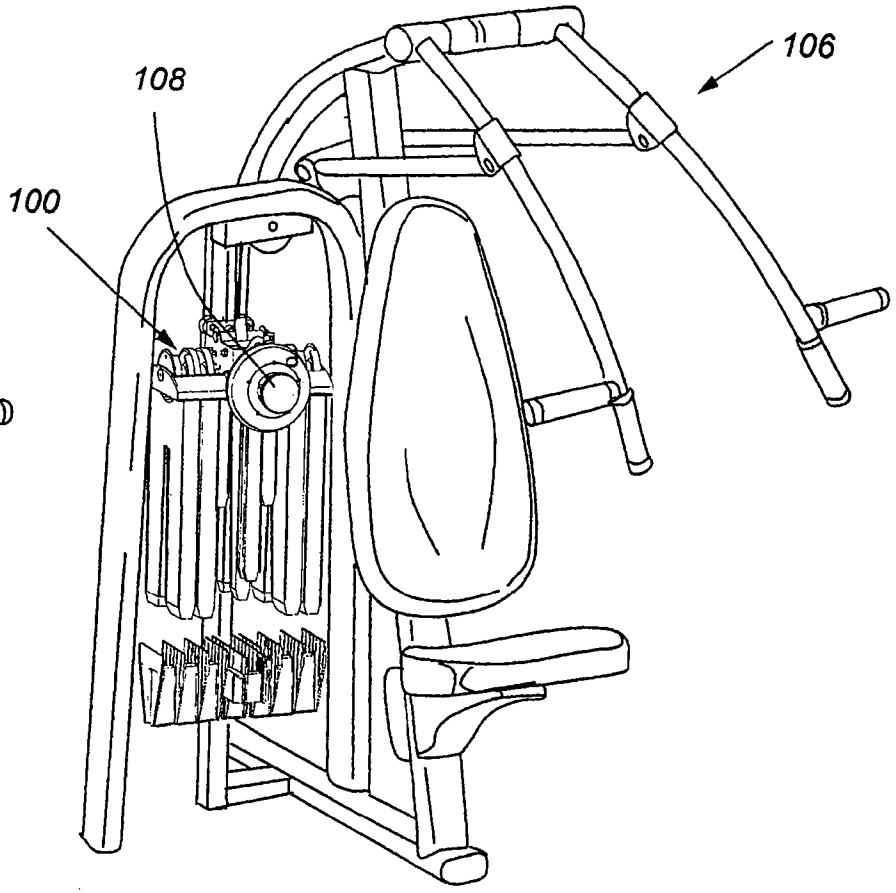
FIG. 2 is a perspective view of the machine of FIG. 1, with the carriage shown in a traveling position away from the start position.
Figure 1:
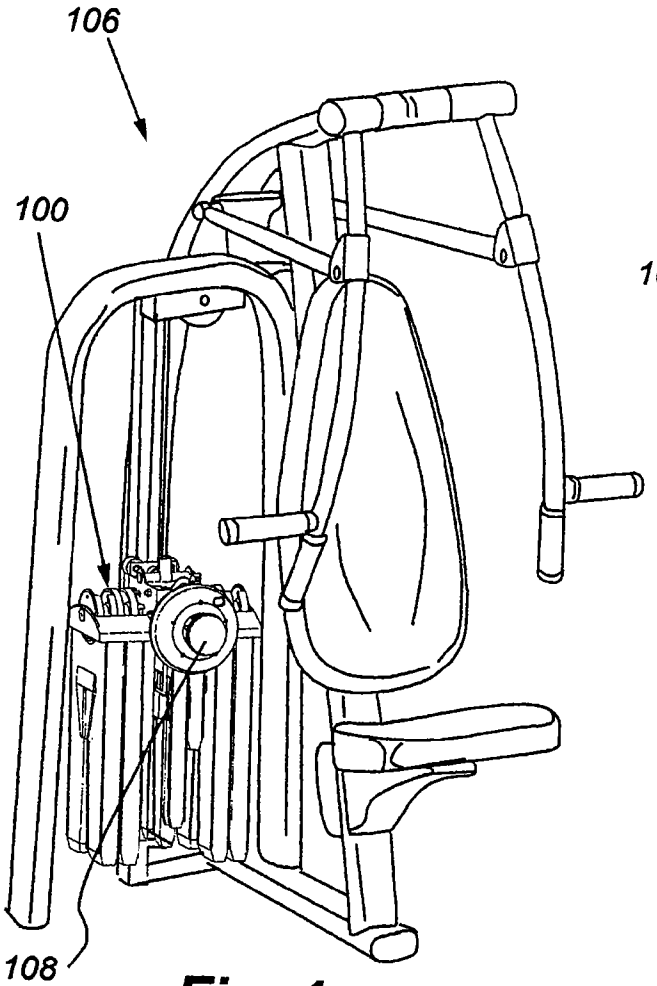
FIG. 1 is a perspective view of an exercise machine with a carriage in a start position, according to certain examples.

The present disclosure relates to a lockout mechanism for a selection mechanism on a weight carrying carriage of an exercise machine as shown in FIGS. 1 and 2. When the carriage 100 is in a starting position (as in FIG. 1), the selection mechanism 108 may be used by the user to select the amount of weight to be lifted from a rack and carried by the carriage 100 to resist exercising movements by the user. The lockout mechanism 156 (see FIG. 4A) may cause the selection mechanism 108 to be immovable when the carriage 100 is moved out of its starting position on the rack. As such, when a user is exercising and the carriage 100 is in use and not in its starting position (as in FIG. 2), the selection mechanism 108 may be prevented from being inadvertently or intentionally adjusted. This may help to prevent dropping of weights or other dangerous conditions associated with adjusting the selection mechanism 108 when the weights carried by the carriage 100 are displaced from their rack.

Figure 3:
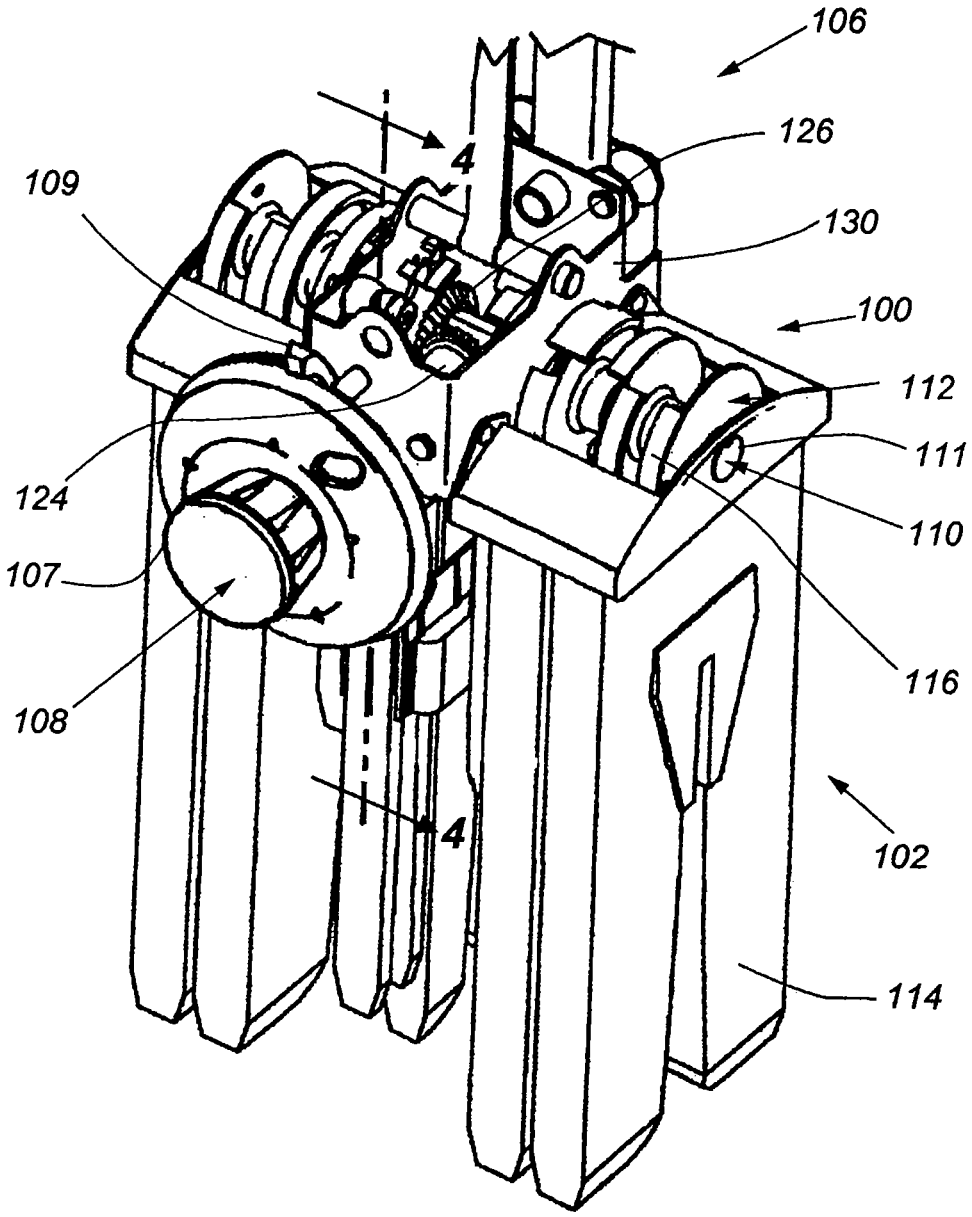
FIG. 3 is a perspective view of the carriage and resistance elements of FIG. 1.

Referring now to FIG. 3, a perspective view of a carriage 100 and a resistance system 102 of a loading portion of an exercise machine 106 is shown. The carriage 100 shown may include a selection mechanism 108, a support system 110, and a plurality of engagement or picking devices 112 arranged on the support system 110. When the carriage 100 is in the starting position, the selection mechanism 108 may be used to adjust the support system 110 thereby adjusting the position of the plurality of engagement devices 112 to select a desired arrangement of resisting elements 114 from the resistance system 102. Once selected, the user may perform exercising motions that are resisted by the weight carrying carriage 100 as it travels along the frame of the loading portion of the machine 106.

The selection mechanism 108 is described in co-pending U.S. patent application Ser. No. 13/077,173, and U.S. Provisional Patent Application Ser. No. 61/319,628, incorporated herein in their entireties. Nonetheless, the basic structure of the selection mechanism is described herein below for completeness.

Figure 4A:
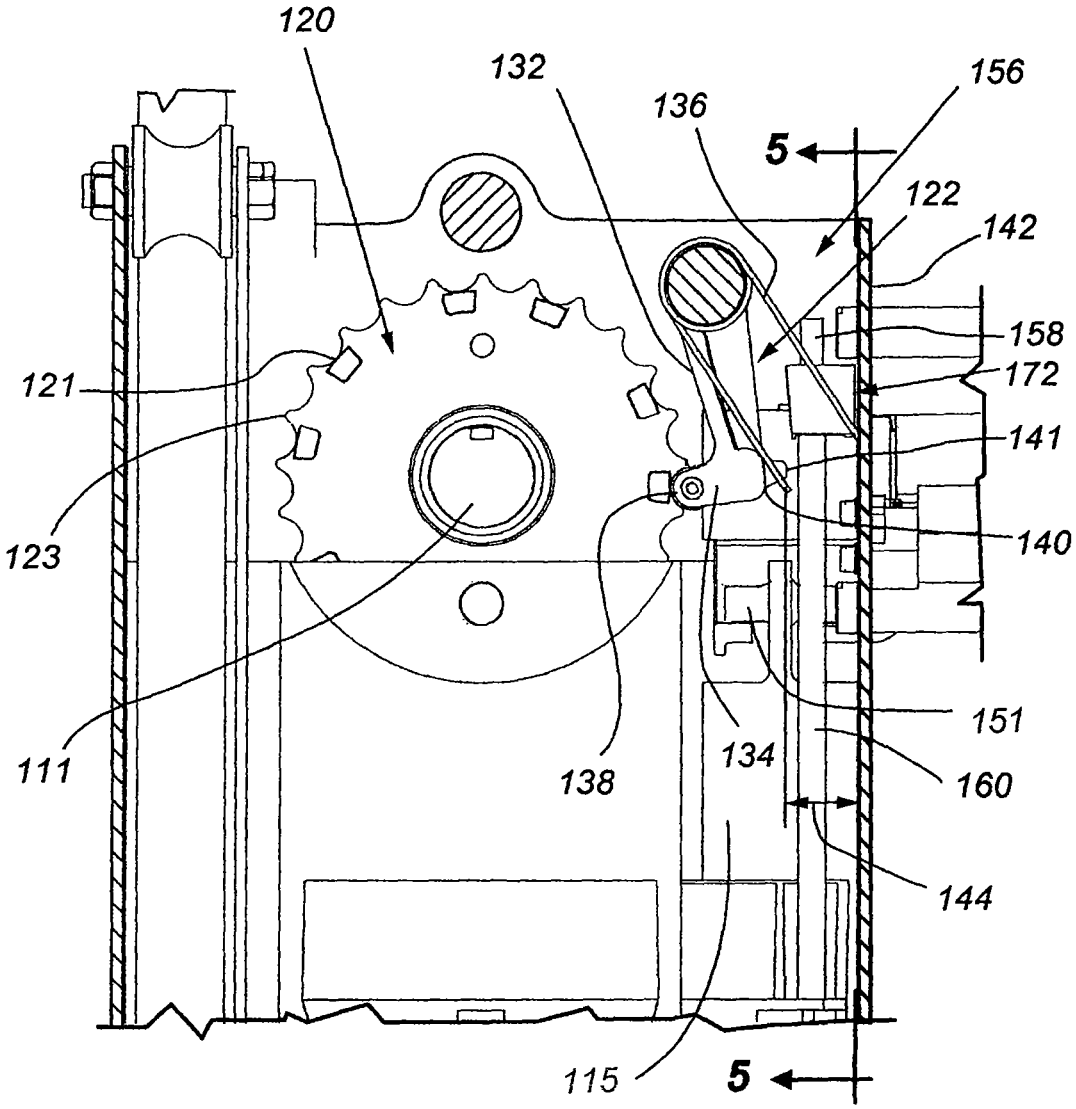
FIGS. 4A and 4B are partial sectional views of a ratchet gear and pawl of the carriage of FIG. 3, in unlocked (FIG. 4A) and locked (FIG. 4B) positions.

The particular arrangement of the carriage 100 shown in FIGS. 3 and 4 includes a plurality of disc shaped engagement devices 112 positioned along a rotatable shaft support system 110. The engagement devices 112 include an interrupted flange 116 extending around the perimeter of the disc for engagement with engagement features on one or more resisting elements 114. Referring also to FIG. 4A, the rotatable shaft support system 110 may include a rotatable shaft 111. A ratchet gear 120 may be positioned on the rotatable shaft 111 for interaction with a ratchet pawl 122 causing a ratcheted rotating movement of the rotatable shaft 111. As such, for any given radial ratchet position or series of positions, a particular set of the engagement devices 112 positioned on the rotatable shaft 111 may be engaged with an engagement feature on one or more resisting elements 114, for example, weight plates.

With continued reference to FIGS. 3 and 4A, the rotatable shaft 111 may be rotated by a selection mechanism 108. The particular arrangement of the selection mechanism 108 shown may include a dial 107 associated with a selection shaft 124 that is oriented perpendicularly to the rotatable shaft 111 of the carriage 100. The two shafts may be mechanically coupled with a bevel gear 126 such that rotation of the selection shaft 124 by the dial 107 causes rotation of the rotatable shaft 111, and thus the plurality of engagement devices 112. The dial 107 may alternatively be more directly associated with the rotatable shaft 111 of the carriage 100 by being placed inline with the rotatable shaft 111 rather than being positioned perpendicularly thereto. A reducing gear for controlling the amount of dial turn relative to the rotatable shaft 111 rotation may also be used. The dial 107 may be used to change the weight carried by the carriage 100 incrementally (e.g., 10 lb increments). The incremental weight increase may be directly or proportionally associated with the several ratcheted positions of the rotatable shaft 111 described herein. The selection mechanism 108 may also include a lever 109 for changing the weight by adding a secondary, or an add-on, weight 115 (see FIG. 6A) smaller than the primary incremental weight (e.g., 5 lb increments). This arrangement of weights allows for the selection of any multiple of the incremental weight or any multiple of the incremental weight plus the add-on weight. The lever 109 may be rotatably mounted about the selection shaft 124 and may include a swing arm configured for engaging an add-on weight. This structure is described in more detail below relative to FIGS. 6A and 6B. In alternative embodiments, the selection mechanism 108 may include a crank, a dial, a sliding member engaging the rotatable shaft 111 with a rack and pinion type engagement, or another type of adjustable selection system.

Figure 4B:
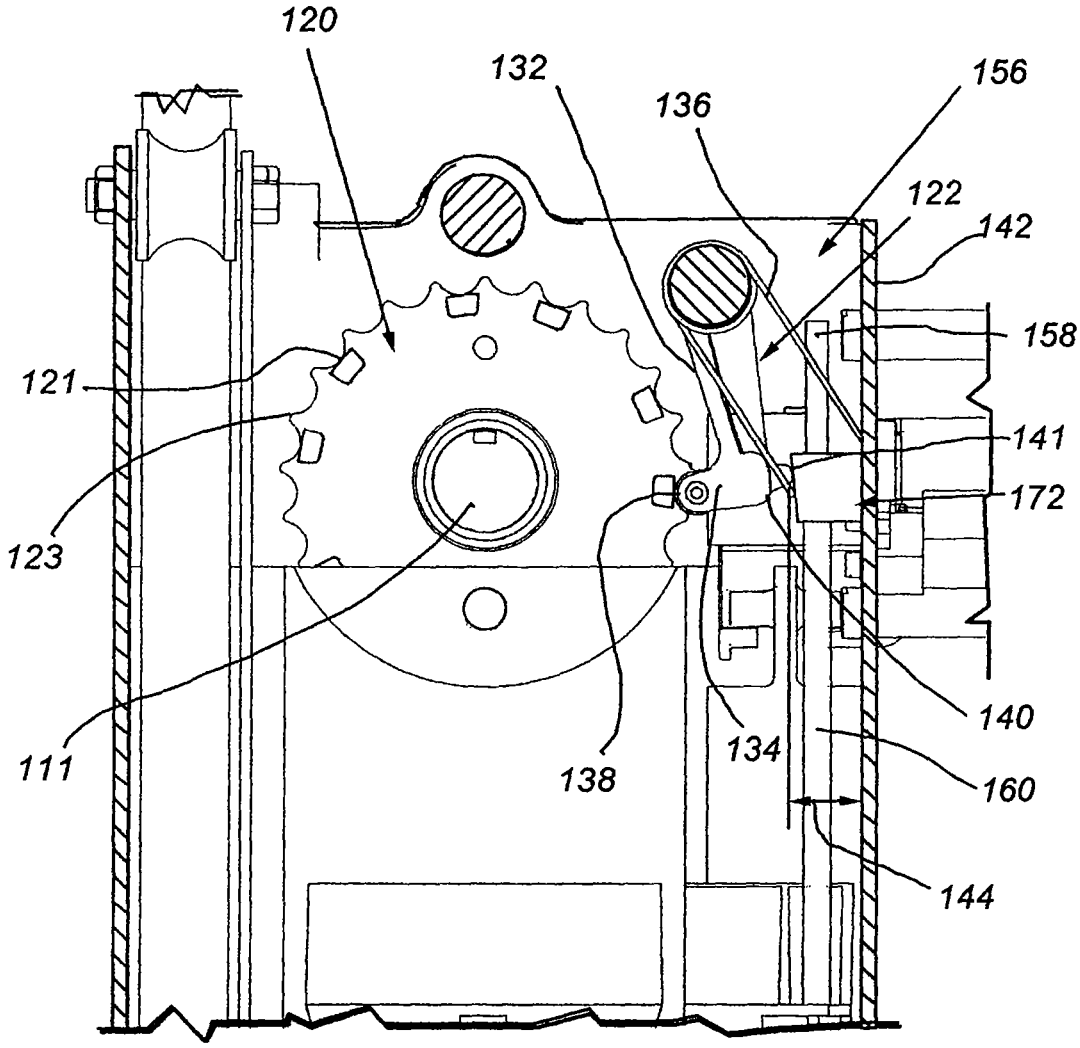
Figure 6A:
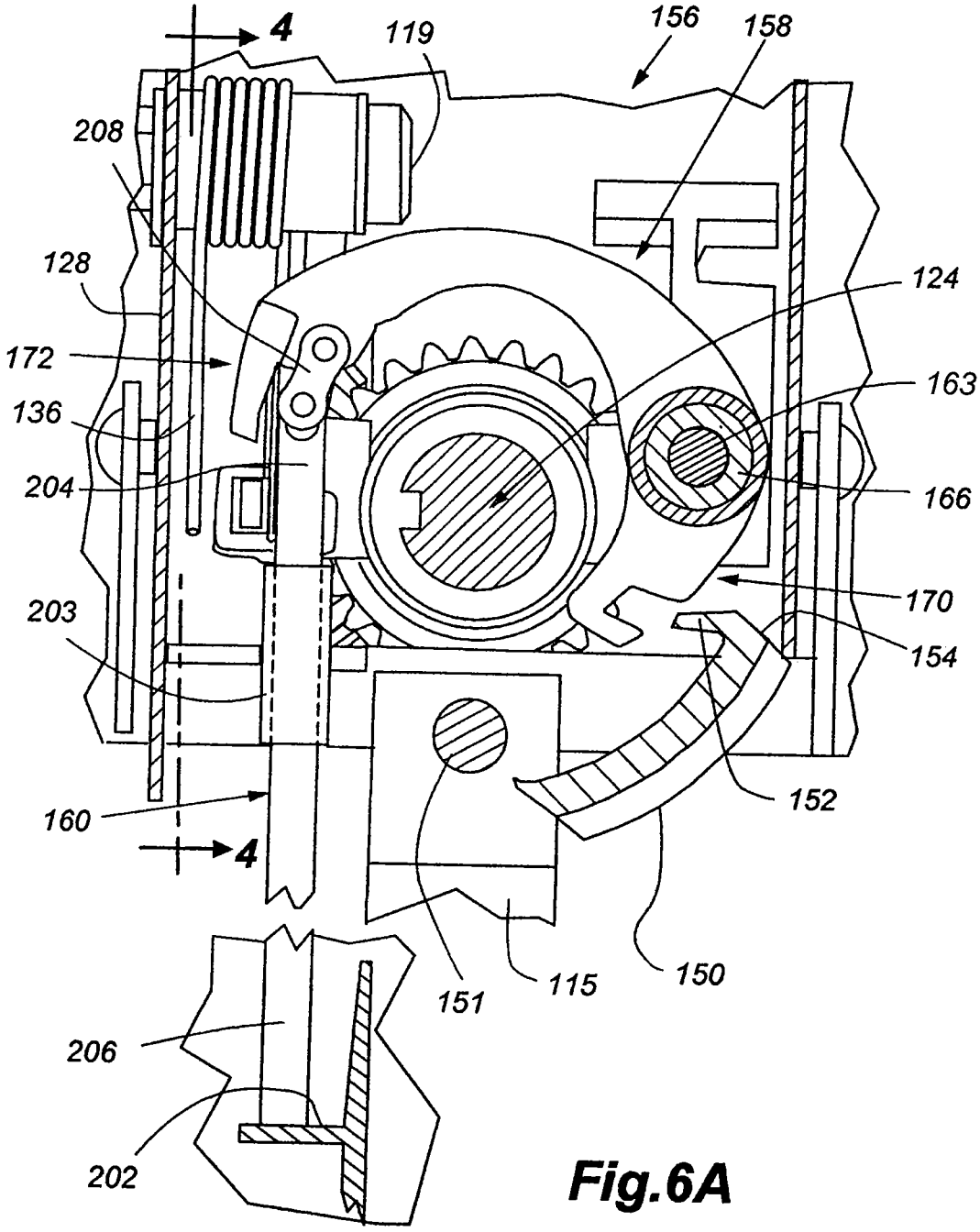
FIGS. 6A and 6B are partial section views of a lockout mechanism of the carriage of FIG. 3, in the unlocked (FIG. 6A) and locked (FIG. 6B) positions.
Figure 6B:
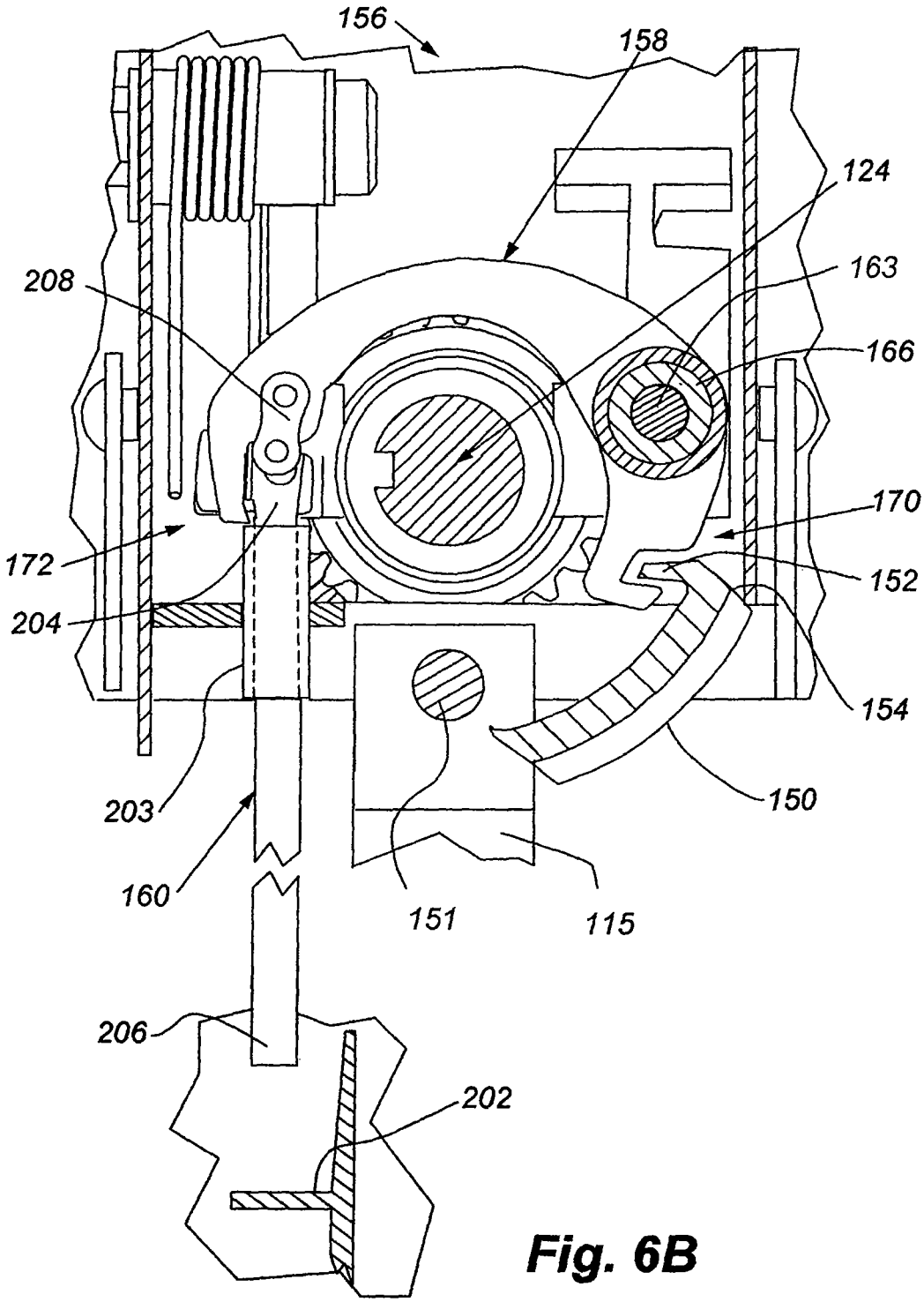

Referring now more particularly, with reference to FIGS. 4A and 4B, to the ratchet gear positioned on the rotatable shaft support system 110 and the associated ratchet pawl 122. The ratchet gear 120 may be positioned on the rotatable shaft 111. The ratchet pawl 122 may engage grooves 121 between teeth 123 on the ratchet gear 120. The pawl 122 may be mounted with a bolt 119 to a side wall 128 of a lifting housing 130 (FIG. 3) of the carriage 100 as best shown in FIGS. 6A and 6B. As is typical of a pawl, the pawl 122 may be biased to engage the grooves 121 on the ratchet gear 120 with a biasing mechanism 136, such as a spring. As may be appreciated, as the shaft 111 is rotated, the pawl 122 is forced against the biasing mechanism as it rides up the face of the teeth 123 on the ratchet gear 120. When the pawl 122 passes over the crest of a tooth on the ratchet gear 120, the pawl 122 is biased down the opposing side of the ratchet teeth 123 and is nested in the groove adjacent to its previous position. While common ratchet systems may only allow for rotation of the ratchet gear 120 in a single direction, bidirectional motion of the ratchet gear 120 may be provided, as shown, by including generally symmetrical ratchet teeth 123.

Referring still to FIGS. 4A and 4B, in the particular ratchet pawl embodiment shown, the ratchet pawl 122 may extend from its mounting bolt 119 on the side wall of the lifting housing 130. The pawl 122 may include an extension portion 132 and an engaging portion 134. The elongated extension portion 132 terminates with the engaging portion 134, which extends generally transversely relative thereto. Forces pressing on the tip 138 of the engaging portion 134, which engages the ratchet gear 120, act relatively perpendicularly to the extension portion 132 causing it to rotate against the biasing mechanism 136 about its attachment bolt 119. The engaging portion 134 may have a butt end 140 opposite the tip 138. The butt end 140 of the engaging portion 134 of the pawl 122 may include a locking protrusion 141 extending away from the butt end 140 of the engaging portion 134 of the pawl. The end of the protrusion 141 may be spaced from a front wall 142 of the lifting housing 130 by a lock gap 144. The lock gap 144 may range in size from approximately ⅛ inch to approximately 2 inches. In other embodiments, the lock gap 144 may range from approximately ¼ inch to approximately 1 inch. In another embodiment, the lock gap 144 may be approximately ½ inch. Several types of ratchet pawls may be provided and a lock gap between a respective engaging portion 134 thereof may also be provided.

In general, FIG. 4A shows carriage in the rest position and the head 172 of a lockout member 158, which may also be referred to as a locking member, in the disengaged position, allowing the ratchet gear 120 and pawl 122 to function and allow the user to actuate the control knob 107 to select of the desired load. FIG. 4B shows the carriage 110 in the use position, with the head 172 of the lockout member 158 in the engaged, or locked-out, position. In this position, the head 172 interferes with the motion of the pawl 122, and thus does not allow the ratchet gear to rotate. Thus, the control knob does not rotate, and the user cannot adjust the selected load.

Figure 5:
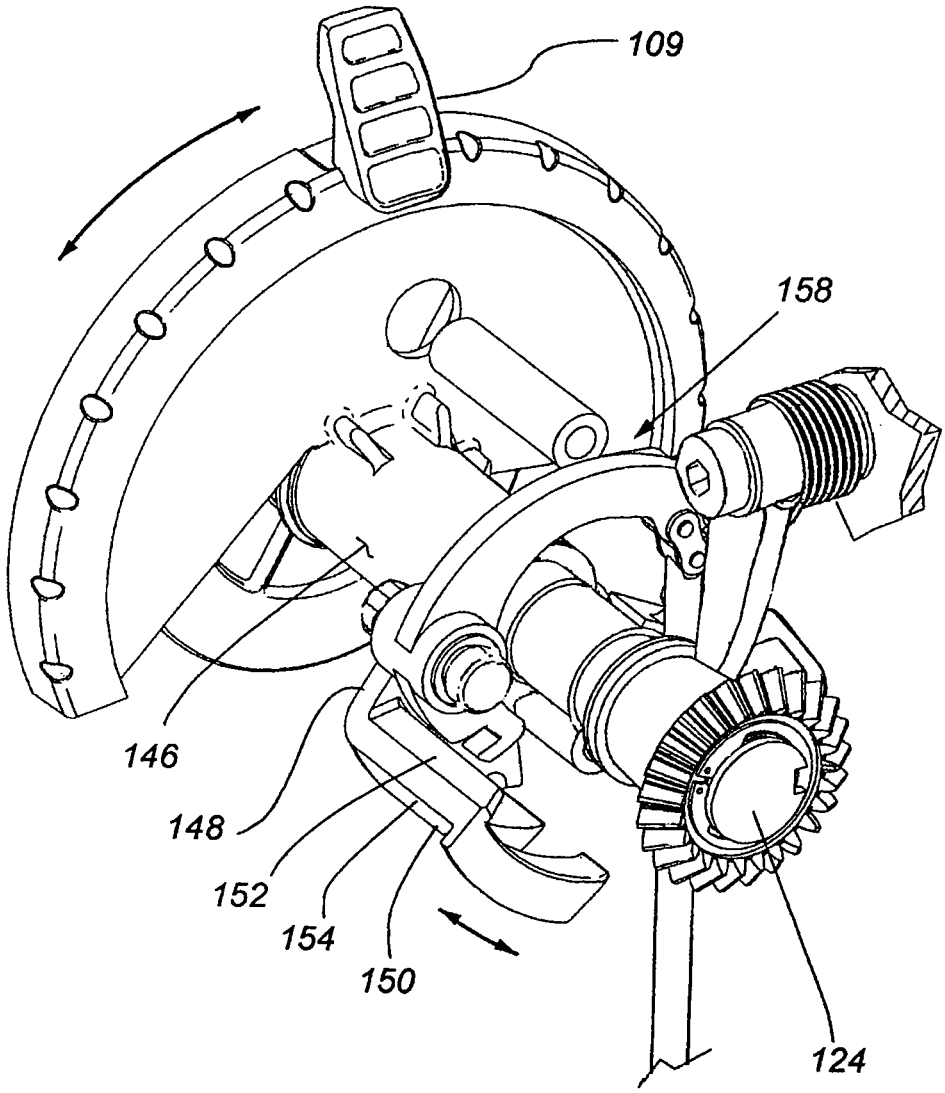
FIG. 5 is a rear perspective view of a lever assembly of a selection mechanism of the carriage of FIG. 3.

Referring now more particularly to the add-on weight lever 109, as shown in FIG. 5, the add-on weight lever 109 of the selection mechanism 108 may be rotatably positioned about the selection shaft 124 via a surrounding collar 146. The surrounding collar 146 may include a swing arm 148 with a shovel type selector, or scoop, 150 wherein rotating the lever 109 and the collar 146 about the selection shaft 124 causes the swing arm 148 to rotate and move the scoop 150 into an engaging position with the engagement feature 151 (see FIG.

8A) of the add-on weight. As shown, the scoop 150 may include a locking ridge 152 extending parallel to the selection shaft 124 and positioned at or near the trailing edge 154 of the scoop 150. While this particular arrangement shows a single add-on weight and thus only two positions for the add-on weight lever 109, additional add-on weights may be provided and picked up by the scoop 150 by providing additional add-on weights and increasing the radial travel of the lever 109 and the scoop 150.

As described above, two selection elements may be used to selectively join resistance elements to the carriage 100: the engagement devices 112 on the main shaft 111 and the lever 109. The lockout mechanism 156 may act to inhibit the use of both of these elements when the carriage 100 is in use. In some embodiments, only one of the two weight selection elements may be locked out by the lockout mechanism described herein.

With this basic understanding of the features and functions of the selection mechanism 108 of the exercise machine 106, the lockout mechanism 156 will now be described in detail. With reference to FIGS. 6A and 6B, the lockout mechanism 156 may include the lockout member 158 and an actuation member 160. The lockout member 158 functions to interrupt the ability to adjust the dial 107 and/or the lever 109 of the selection mechanism 108. The actuation member 160 disengages the lockout member 158 when the carriage 100 is in the rack, thereby freeing the dial 107 and lever 109 for adjustment.

Figure 7:
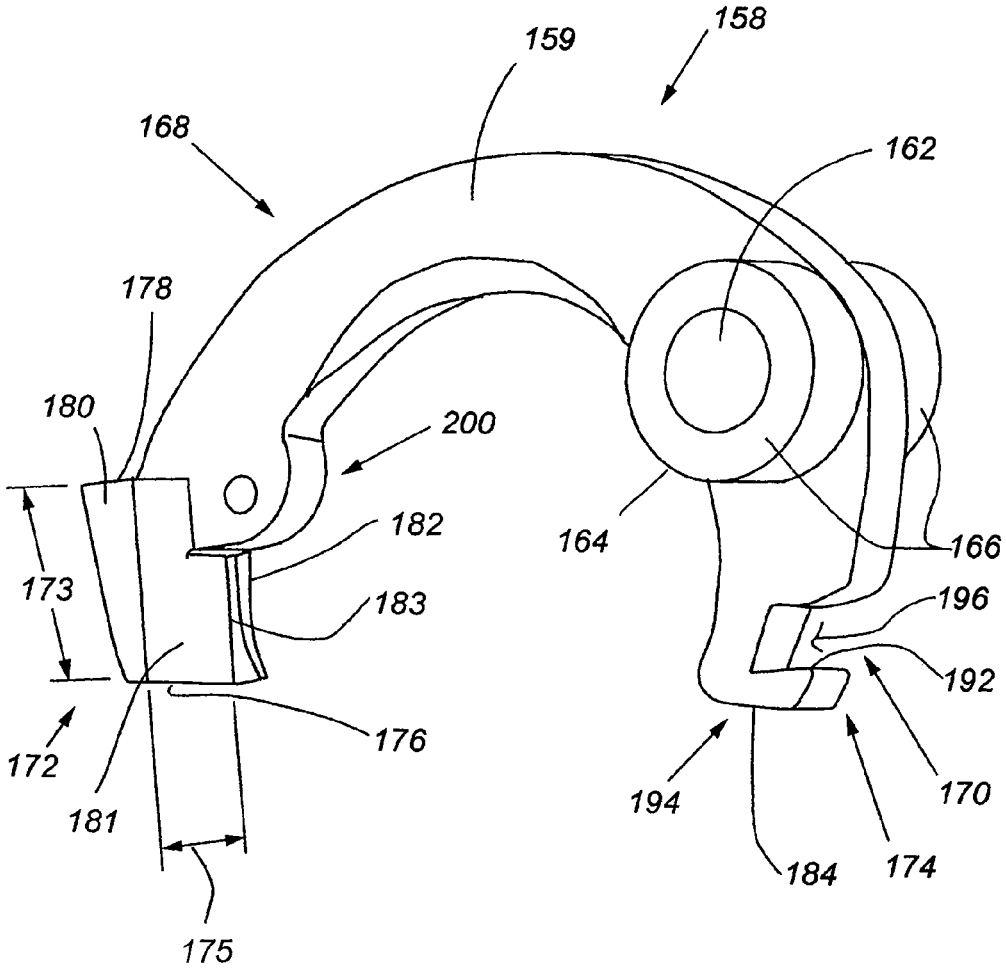
FIG. 7 is a perspective view of a lockout member of the lockout mechanism of FIGS. 5A, 5B, 6A and 6B.

With regard to the lockout member 158, reference is made to FIG. 7. The lockout member 158 may include a generally elongate curved body portion 159 with a generally crescent shape. The lockout member 158 may include a pivot bore 162 formed in a collar 164 and extending through the body portion 159 of the lockout member 160. The lockout member 158 may be secured to the front wall 142 of the lifting housing 130 via a bolt or other fastener 163 passing through the pivot bore 162 and separated from the collar 164 by the one or more bushings 166. The connection of the lockout member 158 to the lifting housing 130 may be such that the lockout member 158 is positioned to partially extend around the selection shaft 124 and lie in a plane generally parallel to the front wall 142 of the lifting housing 130, as best shown in FIGS. 6A and 6B. With continued reference to FIG. 7, the connection may also be relatively tight so as to secure the locking member 158 into position and prevent out of plane displacement, but sufficiently loose so as to avoid deformation of the bushings 166 or other issues that may limit the freedom of the locking member to pivot about the mounting bolt 163 positioned in the pivot bore 162. The lockout member 158 may include a primary end 168 adapted to interfere with and lockout the dial 107 portion of the selection mechanism 108, and a secondary end 170 adapted to interfere with and lockout the lever 109 portion of the selection mechanism 108. The head 172 extends from the primary end 168, and a hook feature 174 extends from the secondary end 170.

For purposes of description, the primary end 168 and the secondary end 170 will now be described, and the terms distal and proximal will be used to indicate the relative position of elements in relation to the pivot bore 162 (e.g., distal is away from the bore and proximal toward the bore). Continuing with FIG. 7, the head 172 may be shovel shaped, and may have a length dimension 173 defined between an end wall 176 and a base wall 178. The head 172 may have a width dimension 175 defined between opposing side walls 180 and 182. The head 172 may be attached at the base wall 178 to the elongated body portion 159, and the head 172 may extend at a relatively sharp angle therefrom. The width 175 of the head 172 may taper down from the base wall 178 to the end wall 176 for clearance purposes. A face 181 of the head may define a groove or recess 183 for allowing the head 172 to move, as described below, with respect to a connection link 208. As seen in FIGS. 4A and 4B, the sidewall 180 may be positioned near front wall 142, and may extend generally parallel to the front wall 142. The opposing sidewall 182 may face the ratchet gear 120 and the pawl 122, and may angle towards the front wall 142 as it extends from the base wall 178 to the end wall 176. The effect of the angle of the sidewall 182 is to create a one-sided, or asymmetrical, tapering of the head 172 as it extends from the base wall 178 to the end wall 176.

The width 175 of the head at the end wall 176 may be slightly smaller than the lock gap 144, and the width 175 of the head at the base wall 178 may be larger than the lock gap 144, the benefits of which will be described below.

Referring to FIGS. 4B and 6B, when the lockout mechanism 156 is engaged, the head 172 may be positioned between the locking protrusion 141 of the pawl 122 and the front wall 142 of the housing 130. One sidewall 180 engages the front wall 142 while the opposing sidewall 182 engages the locking protrusion 141. This position of the head 172 prevents the pawl 122 from moving relative to the ratchet gear 120 as shown in FIG. 4B. The pawl 122 is thus prevented from riding over the teeth 123 of the ratchet gear 120 thereby effecting interference with the rotation of the gear 120. The gear 120 is keyed to the rotatable shaft 111, and the jammed gear prevents the shaft 111 from rotating, preventing the bevel gear 126, the selection shaft 124, and finally the dial 107 from rotating. Because the sidewall 182 that engages the locking protrusion 141 is tapered or beveled, as the head 172 proceeds into engagement with the locking protrusion 141, the head 172 can shift slightly laterally as the bevel side wall 182 rides on the locking protrusion. This causes the head to press against the inside surface of the front wall 142 of the housing thereby reinforcing the locking function of the locking member 156. However, the front wall 142 is not necessary where the locking member 158 is secured sufficiently well to the lifting housing 130 to minimize lateral deflection of the head 172.

Continuing with FIG. 7, to explain the additional lock out function of the lockout mechanism 156 related to the add on (secondary) weights, the interference feature 174 is configured to interact with the locking ridge 152 of the add-on weight lever 109. The feature 174 may be in the shape of a hook so as to secure the locking ridge 152 against motion away from the locking member 158. It may also include an abutting surface 184 to secure the locking ridge 152 against motion toward the locking member 158 in particular circumstances. The hook together with the abutting surface 184 are arranged and positioned so as to lock the lever 109 portion of the selection mechanism 108 in the allowable range of positions for the lever 109.

Referring still to FIG. 7, the hook feature 174 extends from the second end 170 of the locking member 158. The hook feature 174 may include a hook 194 formed by a slot 196. The hook 194 may have a relatively flat slot-side surface 192 and a relatively flat surface forming the abutting surface 184. Each of the slot-side surface 192 and the abutting surface 184 of the hook 194 may be oriented generally perpendicular to a radial line extending through the pivot bore 162 of the locking member 158.

With reference to FIGS. 6A, 6B, 8A, and 8B, several cross-sections revealing the function of the hook feature 174 are shown. FIG. 6A shows the orientation of the lock where the carriage is positioned in the rack such that the locking member 158 is not engaged and the lever 109 is in a first or no add-on weight position. FIG. 6B shows the orientation of the locking member 158 where the carriage is lifted or removed from the rack such that the locking member 158 is engaged and the lever 109 is again shown in a first or no add-on weight position. As shown, when the add-on weight lever 109 is in the first or no add-on weight position, and the lock member 158 is actuated, the lever 109 is rotated to its fully counterclockwise position when viewing the machine from the front. This causes the associated collar 146, swing arm 148, and scoop 150 to be in their full counterclockwise position as well. In this orientation, the locking ridge 152 on the trailing edge 154 of the scoop 150 is positioned as shown in FIG. 6A and its movement is not impeded. The user may move the lever 109 to select an add-on weight or the knob 107 to select a primary weight. In FIG. 6B, for example when the carriage 100 is lifted from the rack, the locking member 158 pivots about the bolt 119 in the pivot bore 162 to its engaged position, causing the hook to engage the locking ridge 152 and prevent the locking ridge 152 from rotating clockwise. As such, the lever 109 cannot be moved to select or deselect a weight.

Figure 8A:
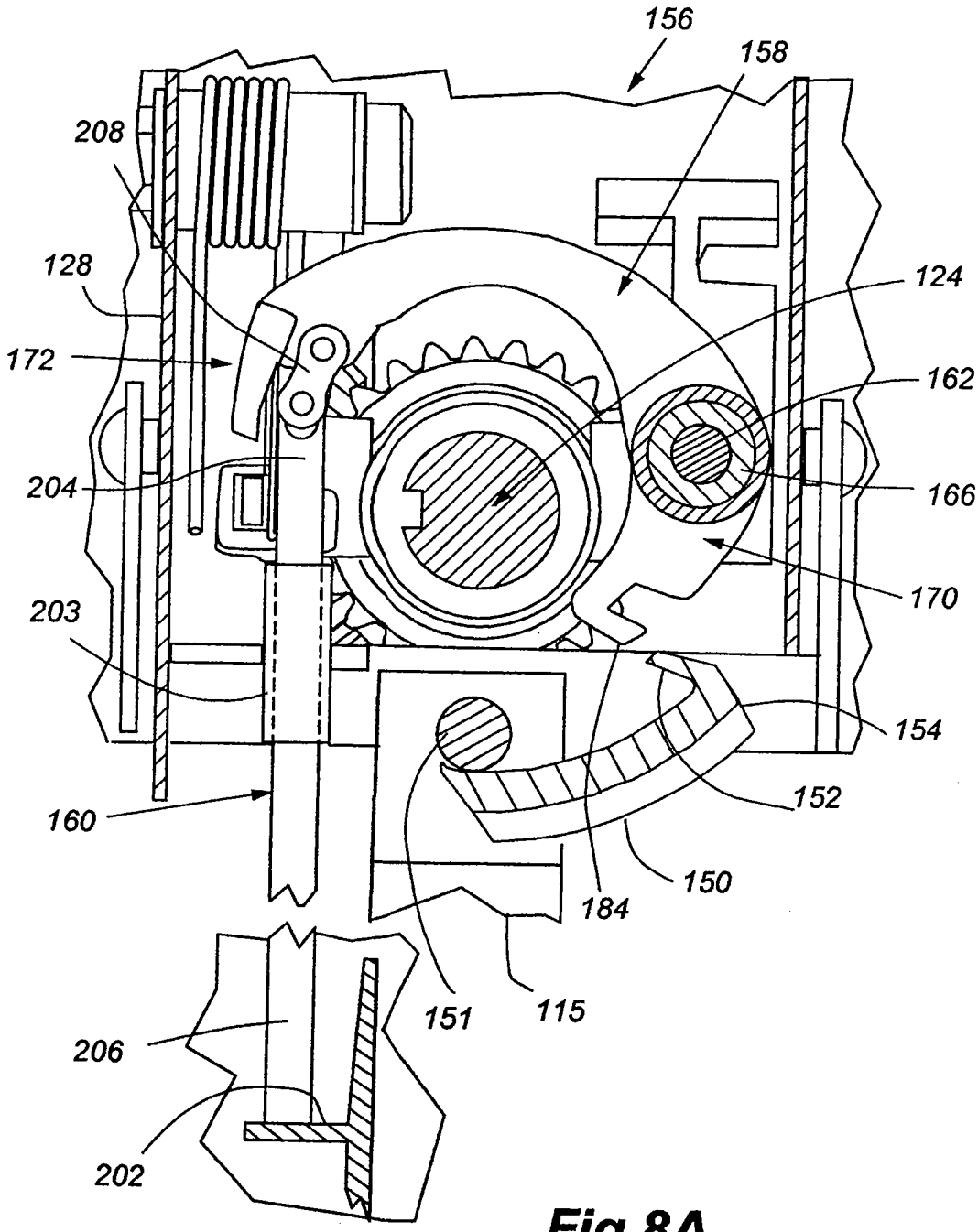
FIGS. 8A and 8B are partial cross-sectional views of the lockout mechanism of the carriage of FIG. 3.
Figure 8B:
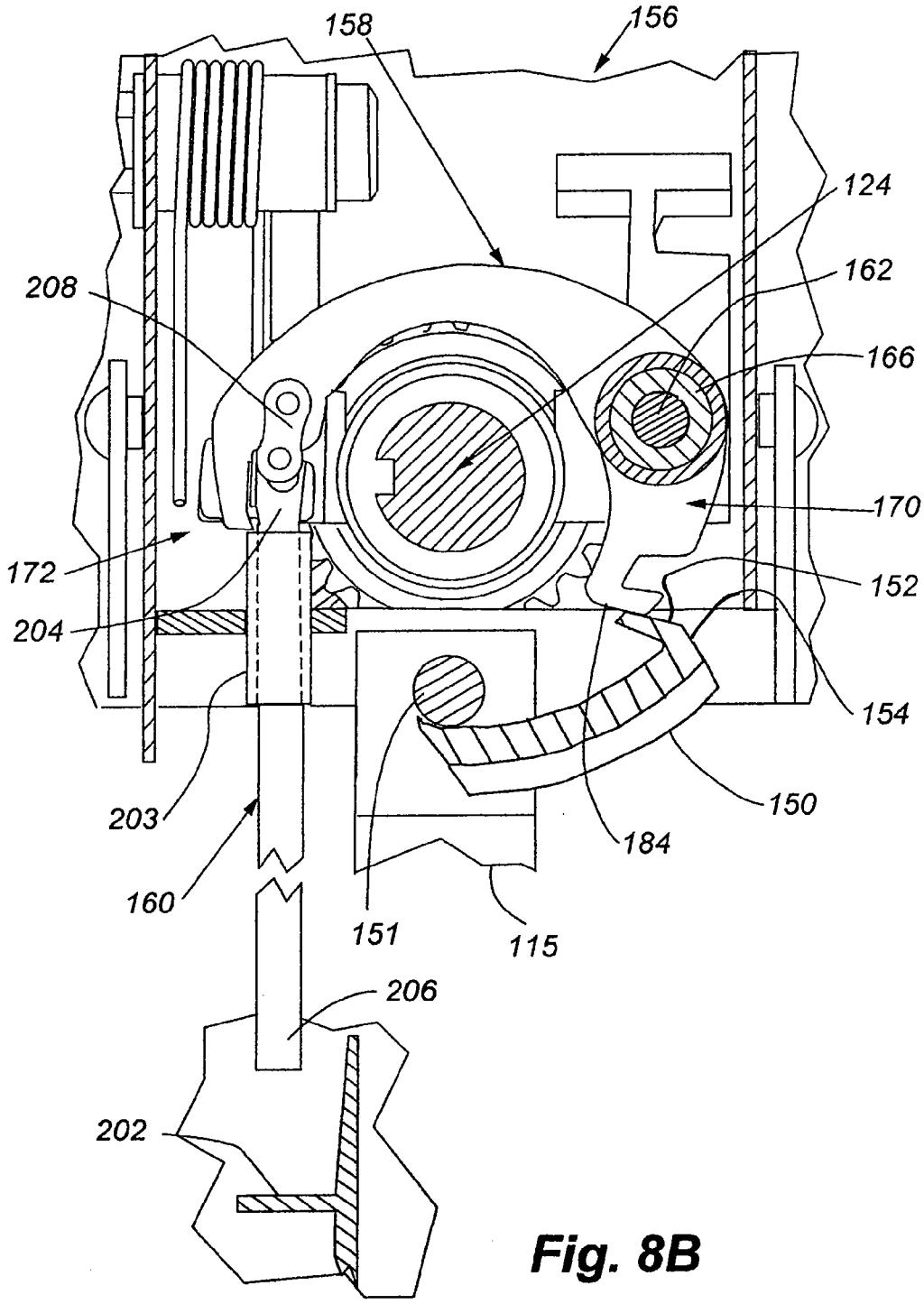

FIGS. 8A and 8B show the same configuration as that shown in FIGS. 6A and 6B, except the lever 109 is now shown in a position where an add-on weight is engaged. As shown, when the add-on weight lever 109 is in the add-on position, the lever 109 is rotated to a position clockwise from the no add-on weight position when viewing the machine from the front. This causes the associated collar 146, swing arm 148, and scoop 150 to rotate clockwise also. In this condition, the locking ridge 152 on the trailing edge 154 of the scoop 150 is positioned as shown in FIG. 8A. Since the carriage 100 is in the rack and the locking member 158 is not engaged, the lever 109 is free to move and the user can select an add-on weight. However, when the carriage 100 is lifted from the rack, the locking member 158 pivots about the bolt 119 in the pivot bore 162 to its engaged position causing the abutting surface 184 of the hook feature 174 to engage the surface 184 of the locking ridge 152 and prevent the locking ridge 152 from rotating counterclockwise. As such, the lever 109 cannot be moved to select or deselect a weight.

Each engagement surface of the locking ridge 152 is oriented generally perpendicularly to a radial line extending from the pivot point of the locking member 158 at the center of the pivot bore 162 when in position for engagement by the locking member 158. That is, when the lever 109 is in the no add-on weight position, the scoop side of the locking ridge 152 is oriented generally perpendicular to a radial line extending through the pivot point of the locking member 158. When the lever 109 is in the add-on weight position, the opposing side of the locking ridge 152 is oriented generally perpendicular to a radial line extending through the pivot point of the locking member 158. As such, the thickness of the locking ridge 152 tapers slightly as it extends inwardly toward the selection shaft 124. In addition, in the engaged position, the secondary end 170 of the locking member 158 generally tracks along the circumferential path defined by the position of the locking ridge 152 relative to the center of rotation of the swing arm 148 and scoop 150 (e.g., the center of the selection shaft 124). As such, any forces attempting to cause clockwise or counterclockwise motion of the locking ridge 152 along this circumferential path are absorbed by the locking member 158 and are transmitted relatively closely through the pivot point of the locking member 158 at the pivot bore 162. Further, a tendency for forces on the lever 109 to disengage the locking member 158 by rotating the locking member 158 may be avoided due to such forces being generally non-eccentric relative to the pivot point of the locking member 158.

Before moving on to the actuation member 160 of the lockout mechanism 156, the lockout member 158 may be any member arranged for movement between an engaged position interfering with the ratchet gear and pawl, as well as the lever 109. In the engaged position, the lockout member 158 may be positioned to interrupt motion of the dial 107 and lever 109 of the selection mechanism 108. In the disengaged position, the lockout member 158 may be isolated from the dial 107 and the lever 109 allowing them to be freely adjusted. As such, the lockout member 158 may include one or a combination of several types of interrupting members, such as, a stop, a block, a curb, or a hook. Other forms of interrupting members may be provided, such as, for example, a wedge to stop rolling motions. The lockout member 158 may also include a biasing mechanism for biasing the member toward an engaged or a disengaged position. In addition, the head 172 may be any shape and may be configured for insertion between the locking protrusion 141 of the pawl 122 and the front wall 142 of the lifting housing 130. Rectangular, round, oval, oblong, or irregular shaped heads may be provided or other shapes may also be used.

As described with respect to FIGS. 6A and 6B, the lockout mechanism 156 further includes an actuation member 160 configured to automatically engage and disengage the locking member 158. The actuation member 160 may be configured to, when the carriage 100 is at rest, disengage the locking member 158 from the pawl 122 and the lever 109; and when the carriage 100 is in use, engage the locking member 158 with the pawl 122 and the lever 109.

Referring particularly to FIGS. 6A and 6B, a particular example of an actuation member 160 is shown. In this embodiment, the actuation member 160 may be in the form of a release rod. The actuation member 160 may be positioned between the head 172 of the locking member 158 and a stop 202 positioned on the frame of the loading portion of an exercise machine 106. As also shown, the actuation member 160 may be received by and may pass through a positioning sleeve 203 joined to the carriage 100. The actuation member 160 may include a top locking member end 204 and a bottom stop end 206. The locking member end 204 may be pivotably connected to a connection feature 200 of the locking member 158. The connection feature 200 may be proximal to the head 172 of the locking member 158 and may include a connection eye, a bore, a pin or protruding probe. Other connection features 200 may be provided. The connection feature 200 may be configured for attachment to the actuation member 160 to allow pivoting motion therebetween. For example, as shown herein, the locking member end 204 may be pivotably coupled to a link member 208, which in turn may be pinned to the connection feature 200 on the locking member 158. As such, while the connection feature 200 on the locking member 158 may move along a radial arc about the pivot bore 162 of the locking member 158, the actuation member 160 may move in a linear up and down direction, with the horizontal component of movement of the connection feature 200 being accommodated by the link member 208. The horizontal component of motion of the locking member 158 may cause the face 181 of the head 172 of the locking member 158 to interfere with the locking member end 204 of the actuation member 160. It is for this purpose that the recess 183 may be provided in the face 181 of the locking member 158 as previously described.

The actuation member 160 may be sized to cause disengagement of the locking member 158 from the pawl 122 and the lever 109 when the carriage 100 is positioned in a rest or non-use position. The length of the actuation member 160 may be slightly greater than the distance between the stop 202 positioned on the frame and a bottom side of the pawl 122. In addition, the major cross-sectional dimension of the actuation member 160 may be smaller than the lock gap 144, such that when the actuation member 160 is within the gap 144, in a lockout releasing position, the pawl 122 may move sufficiently to ride over the teeth 123 of the ratchet gear 120. Alternative actuation members can be provided and can include forcing devices that cause the lockout member 158 to move from disengaged with the pawl 122 and the lever 109 when in the rest position to engaged with the pawl 122 and the lever 109 when being used.

In the start position, as shown in FIGS. 6A and 8A for example, the actuation member 160 rests on the stop 202 and extends upward in the gap 144, thus holding the head 172 of the locking member 158 out of the locking gap 144 leaving the pawl 122 and ratchet gear 120 to operate freely. Since the actuation member 160 is holding the head 172 out of the gap 144, the locking member 158 is held in a disengaged position and the hook feature 174 at the secondary end is also held away from the locking ridge 152 of the lever 109. As the carriage 100 is lifted and moved from the rack, the actuation member 160 moves downwardly a short distance relative to the carriage due to gravitational forces. Thus, the actuation member 160, linked to the head 172, tends to pull the head down, or at least allow the head 172 to fall into the gap 144. When positioned in the gap 144, the head 172 abuts the locking protrusion 141 of the engaging portion 134 of the pawl 122 and prevents the dial 107 from moving.

Additionally, as the head falls into the gap 144, or is pulled into the gap 144 by the actuation member 160, the secondary end 170 of the locking member 158 pivots about the bolt 119 in the bore 162 causing the hook feature 174 to move toward the locking ridge 152. Once the rack has been lifted far enough that the actuation member 160, still resting on the stop 202, clears the gap 144, the head fully enters the gap 144 and the hook feature 174 fully engage with the locking ridge 152, thereby preventing both the lever 109 and the rotatable shaft 111 from moving. In this condition, the actuation member 160 may be said to be in the engaged position. The actuation member 160 may also be spring loaded or the locking member 158 may include a biasing mechanism integrated into its connection to the lifting housing 130, similar to a spring loaded hinge. These mechanisms may more forcefully bias the head to enter the gap 144 upon lifting the rack. Other biasing mechanisms may be used.

When the user is finishing a particular set of repetitions and the carriage 100 approaches the starting position, the stop end 206 of the actuation member 160 contacts the stop 202, which prevents the actuation member 160 from continuing to move with the carriage 100. Accordingly, as the carriage 100 continues to approach the start position, the locking member end 204 of the actuation member 160 presses upward via the link member 208 on the head 172 of the locking member 158, while the actuation member 160 maintains an upright orientation due to the sleeve 203. The upward force from the actuation member 160 on the head 172 of the locking member 158 causes the head 172 of the locking member 158 to rotate out of abutment with the locking protrusion 141 of the engaging portion 134 of the pawl 122 and further causes the hook feature 174 of the locking member 158 to rotate out of hooked or abutting engagement with the locking ridge 152 of the lever 109 of the lockout mechanism 156 depending on the position of the lever 109. In this condition, the actuation member can be said to be in a lockout releasing (disengaged) position. The resulting rotation of the lockout member 158 may thus allow for adjustment of the selection mechanism 108 when the carriage 100 is in a start position.

As described, the lockout mechanism can function to lockout a selection mechanism of an exercise machine when the weight carrying carriage has lifted weight plates off of a rack. As such, the mechanism can create a safe environment for users because dangers associated with disengagement of one or more engagement devices can be avoided.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the present invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. Changes in detail or structure may be made without departing from the spirit of the invention as defined in the appended claims. Accordingly the matter contained in the above description or shown in the accompanying drawings shall be interpreted as illustrative only and not limiting.

What is claimed is:

1. A lockout mechanism for a selection mechanism on an exercise machine, the selection mechanism operatively associated with a carriage for selectively carrying load, the carriage including a support system adjustable by the selection mechanism for adjusting the amount of load to be carried, the lockout mechanism comprising:

a lockout member configured to prevent adjustment of the selection mechanism during exercise, the lockout member including an engaged position and a disengaged position, the lockout member comprising an end with a head configured to abut the selection mechanism in the engaged position thereby preventing adjustment of at least a first selection element of the selection mechanism;

an actuation member configured to move the lockout member from the engaged position to the disengaged position; and the lockout member is pivotable between the engaged position and the disengaged position.

2. The lockout mechanism of claim 1, wherein the lockout member is biased towards an engaged position.

3. The lockout mechanism of claim 2, wherein the actuation member comprises a rod, the rod is connected to the lockout member with a link, and horizontal motion of the lockout member relative to the rod is accommodated by the link.

4. A lockout mechanism for a selection mechanism on an exercise machine, the selection mechanism operatively associated with a carriage for selectively carrying load, the carriage including a support system adjustable by the selection mechanism for adjusting the amount of load to be carried, the lockout mechanism comprising:

a lockout member configured to prevent adjustment of the selection mechanism during exercise, the lockout member including an engaged position and a disengaged position, the lockout member comprising an end with a head configured to abut the selection mechanism in the engaged position thereby preventing adjustment of at least a first selection element of the selection mechanism; and an actuation member configured to move the lockout member from the engaged position to the disengaged position, wherein the actuation member is displaceably positioned on the carriage and is moveable between a lockout releasing position and an inactive position, the lockout releasing position causing the lockout member to be positioned in a disengaged position.

5. The lockout mechanism of claim 4, wherein the actuation member is configured to abut a stop on the exercise machine when the carriage is in a rest position, the abutment of the stop causing the actuation member to be positioned in the lockout releasing position.

6. The lockout mechanism of claim 5, wherein moving the carriage out of the start position causes the actuation member to move away from the stop and move to the inactive position.

7. A lockout mechanism for a selection mechanism on an exercise machine, the selection mechanism operatively associated with a carriage for selectively carrying load, the carriage including a support system adjustable by the selection mechanism for adjusting the amount of load to be carried, the lockout mechanism comprising:

a lockout member configured to prevent adjustment of the selection mechanism during exercise, the lockout member including an engaged position and a disengaged position, the lockout member comprising an end with a head configured to abut the selection mechanism in the engaged position thereby preventing adjustment of at least a first selection element of the selection mechanism; and an actuation member configured to move the lockout member from the engaged position to the disengaged position, wherein the lockout member includes a secondary end comprising a hook configured to hook or abut at least a second selection element of the selection mechanism in the engaged position thereby preventing adjustment of the at least the second selection element of the selection mechanism.

8. The lockout mechanism of claim 7, wherein the lockout member includes a crescent shaped body and is pivotable about a pivot point, the pivot point located between the primary and secondary ends.

9. The lockout member of claim 8, wherein the first selection element includes a dial and the selection element includes a lever, the primary end of the lockout member being adapted to operably engage the dial and the secondary end of the lockout member being adapted to operably engage the lever.

10. The lockout member of claim 9, wherein rotation of the dial causes rotation of a shaft including a ratchet gear attached thereto and engaged by a pawl, the primary end of the lockout member abutting the pawl in the engaged position, thereby preventing rotation of the ratchet gear and the shaft.

11. The lockout member of claim 9, wherein the lever comprises a first selection position and a second selection position, the lever including a locking ridge and the locking member including an abutting surface, the locking ridge received in a recess formed in the secondary end of the lockout member when the lever is in the first selection position, and being abutted against the abutting surface in the engaged position when the lever is in the second selection position.

* * * * *